US006648184B1

(12) United States Patent
Williams et al.

(10) Patent No.: US 6,648,184 B1
(45) Date of Patent: Nov. 18, 2003

(54) REFILLABLE WATER BOTTLE SYSTEM

(76) Inventors: Eugene T. Williams, 841 S. Ash St., Ottawa, KS (US) 66067; Claudia L. Williams, 841 S. Ash St., Ottawa, KS (US) 66067; Blair Sutton, P.O. Box 418, Ottawa, KS (US) 66067

( * ) Notice: Subject to any disclaimer, the term of this patent is extended or adjusted under 35 U.S.C. 154(b) by 5 days.

(21) Appl. No.: 10/171,322

(22) Filed: Jun. 13, 2002

(51) Int. Cl.[7] ..... B67D 5/02; B67D 5/36

(52) U.S. Cl. ..... 222/487; 222/484; 222/610; 222/628; 222/146.6

(58) Field of Search ..... 222/482, 483, 222/484, 487, 610, 628, 146.6

(56) References Cited

U.S. PATENT DOCUMENTS

| | | | | | |
|---|---|---|---|---|---|
| 28,799 | A | * | 6/1860 | Wilhelm | 222/487 |
| 169,782 | A | * | 11/1875 | Dehlinger | 222/487 |
| 1,195,102 | A | * | 8/1916 | Schmidt | 222/487 |
| 1,823,935 | A | * | 9/1931 | George | 222/484 |
| 1,833,150 | A | * | 11/1931 | Beechlyn et al. | 222/487 |
| 3,572,553 | A | | 3/1971 | Ogden | |
| 4,030,634 | A | | 6/1977 | Osborn | |
| 4,881,661 | A | | 11/1989 | Jones | |
| 4,958,747 | A | | 9/1990 | Sheets | |
| 4,987,746 | A | | 1/1991 | Roberts | |
| 5,477,980 | A | * | 12/1995 | Chaffin | 222/484 |
| 5,611,459 | A | | 3/1997 | Hinch | |
| 5,638,991 | A | | 6/1997 | Todden et al. | |
| 6,056,154 | A | | 5/2000 | Fowler | |
| 6,311,877 | B1 | * | 11/2001 | Yang | 222/484 |

* cited by examiner

*Primary Examiner*—Kenneth Bomberg
(74) *Attorney, Agent, or Firm*—Dale J. Ream

(57) ABSTRACT

A refillable water bottle system includes a container having a neck defining an outlet and receivable by a conventional bottled water dispenser. Opposite the neck, the container includes a cap defining an inlet for receiving water into the container. A first lever is coupled to the cap and pivotally movable about a horizontal axis between a closed configuration covering the inlet and an open configuration displaced therefrom. A second lever is coupled to the cap and pivotally movable about the same horizontal axis. A ball valve is suspended within the container and tethered to the second lever such that movement thereof seals or unseals the outlet. The second lever is larger than the first lever and longitudinally aligned therewith, making the first lever inaccessible at its closed configuration when the second lever is at its unsealed configuration. This prevents a user from opening the inlet prior to sealing the outlet.

20 Claims, 5 Drawing Sheets

REFILLABLE WATER BOTTLE SYSTEM

BACKGROUND OF THE INVENTION

This invention relates generally to portable bottled water dispensers and, more particularly, to a refillable water bottle system which ensures that the outlet of a water container received and in use by a bottled water dispenser is sealed before an inlet port of the container may be opened.

A conventional water cooler/dispenser receives the neck of an inverted water bottle and dispenses water therefrom. When the water bottle is empty, it must be removed from the cooler and a new water bottle must be carried, lifted, and mounted atop the cooler. This operation can be very awkward and is especially challenging or even impossible for persons unable to lift heavy objects or whose mobility, stability, or dexterity is diminished. A traditional portable water bottle weighs about 45 pounds.

Various devices have been proposed for dispensing water directly from a water bottle positioned on the ground (i.e. no inversion or lifting) or for refilling another container already mounted to a water dispenser. Although assumably effective for their intended purposes, the existing devices do not provide safeguards for preventing the inlet opening (i.e. a refill opening) from being opened prior to sealing the outlet opening. This is important in that water remaining in the container will completely pour out of the outlet opening if the partial vacuum inside the container is broken by opening the inlet opening.

Therefore, it is desirable to have a refillable water bottle system having a single inlet port both for releasing the container vacuum and for receiving refill water. Further, it is desirable to have a system in which a container outlet aperture must be sealed before the inlet aperture may be opened. In addition, it is desirable to have a system including a cart for transporting refill bottles into proximity of a water cooler and having a pump for conveying water from a refill bottle into the cooler container.

SUMMARY OF THE INVENTION

A refillable water bottle system according to the present invention includes a container having a neck capable of being received by a conventional water cooler/dispenser unit, the neck defining an outlet aperture. The container also includes a cap releasably coupled to a top wall of the container, the cap defining an inlet port. The cap also includes a pair of levers for selectively sealing and unsealing the inlet port and outlet aperture. The levers are pivotally coupled to the cap and are arranged such that the lever for sealing/unsealing the outlet aperture completely covers the lever for sealing/unsealing the inlet port when the inlet port is sealed and the outlet aperture is unsealed. Therefore, the inlet port may not be unsealed/opened until the outlet aperture is sealed and, inversely, the outlet aperture may not be unsealed until the inlet port is sealed/closed. This is important in that opening the inlet port releases the partial vacuum that exists inside the container during normal usage which, in turn, allows water in the container to completely flow out of the outlet aperture if it remains unsealed. Obviously, this causes a significant mess. The refillable water bottle system further includes a pump for conveying bottled water from a refill bottle into the main container. The pump may be mounted to the conventional water cooler unit or to a special cart suited for transporting a refill water bottle.

Therefore, a general object of this invention is to provide a refillable water bottle system that enables a user to consume bottled water without having to lift and mount replacement water bottles.

Another object of this invention is to provide a water bottle system, as aforesaid, which prevents a user from mistakenly or inadvertently releasing the vacuum within a water bottle (i.e. opening the inlet port) prior to sealing the outlet aperture thereof.

Still another object of this invention is to provide a water bottle system, as aforesaid, which prevents a user from mistakenly or inadvertently unsealing the outlet aperture prior to sealing/closing the inlet port.

Yet another object of this invention is to provide a water bottle system, as aforesaid, having a cart particularly suited for transporting a refill water bottle.

A further object of this invention is to provide a water bottle system, as aforesaid, having a self-priming pump for conveying water from a refill water bottle into a main water container mounted atop a water dispenser unit.

A still further object of this invention is to provide a water bottle system, as aforesaid, in which the pump is mounted to the cart.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
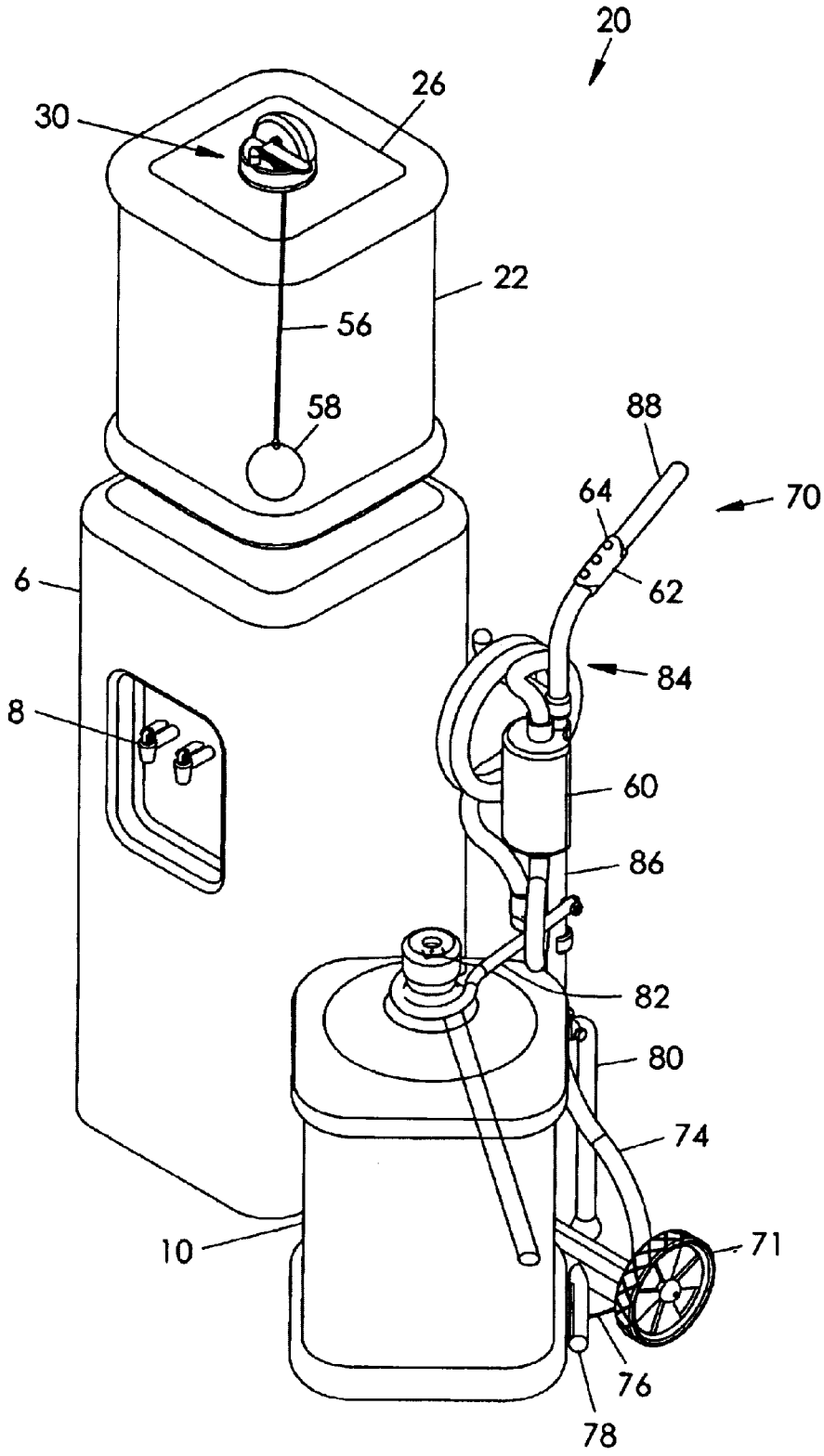
FIG. 1 is perspective view of a refillable water bottle system according to the present invention in use with a conventional water cooler/dispenser unit.

A refillable water bottle system according to the present invention will now be described in detail with reference to FIGS. 1 through 5 of the accompanying drawings. More particularly, the refillable water bottle system 20 includes a main container 22 constructed of a durable plastic material such as a transparent engineering thermoplastic. The container 22 includes a generally rectangular configuration and is capable of holding about five gallons of water (FIG. 1) although containers of other sizes, volumes, and configurations would also be suitable. Preferably, the container 22 includes a bottom that forms a neck 24 with the lower end of the neck defining an outlet aperture. The neck 24 may be received in a top opening of a conventional water dispenser unit 6. To this extent, the configuration of the container 22 is substantially similar to that of a conventional portable water bottle that may be used with a conventional water cooler/dispenser unit 6 (FIG. 1).

The basic function of a conventional water dispenser unit 6 is understood. Generally, a water dispenser unit 6 defines a top opening adapted to receive the neck of an inverted water bottle and includes a reservoir into which water from the water bottle is dispensed via gravity. As the water is flowing out in this situation, the bottle is an "open system." Water flowing from the bottle into the reservoir is exchanged with air until the bottle is empty or until the water level in the reservoir is above the neck aperture of the bottle. The latter case is a "closed system" in which the neck opening is sealed and prevents air from being exchanged for water. Since air cannot enter the reservoir or bottle, water cannot leave. This circumstance creates a partial vacuum at the top of the bottle because the bottle is sealed and gravity is still pulling the water down. If water is dispensed from a water cooler spigot 8, then the water level of the reservoir goes down and allows additional air/water exchange within the bottle ("open system") until the reservoir water level again seals the outlet aperture ("closed system").

Referring again to the present invention, the main container 22 includes a top wall 26 that defines a circle-shaped top opening. The container 22 also includes a cap 30 that may be threadably coupled to the top wall 26 so as to cover the top opening. This cap 30 is selectively removable for cleaning purposes and the like. The cap 30 seals the top opening when threadably coupled thereto. The cap 30 includes a partial dome-shaped structure 32 that defines an interior chamber in communication with the interior of the container 22, as to be described more fully below. The cap 30 also includes a top wall 34 defining an inlet port 36 and a one-way air valve 38 (FIG. 3*c*). According to fluid dynamic principle explained previously, water held in the container 22 will freely flow out of the outlet aperture and overflow the dispenser unit reservoir if the inlet port 36 is opened. Such an occurrence creates an "open system" such that water drained by gravity is replaced by air drawn into the container 22. Thus, the inlet port 36 and outlet aperture must be selectively closable in appropriate situations.

Figure 3A:
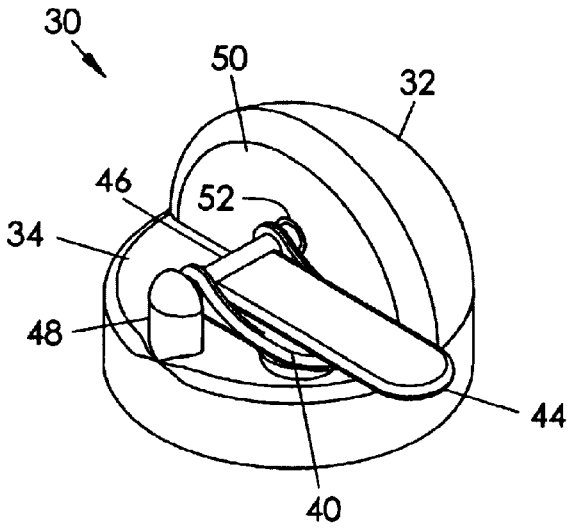
FIG. 3*a* is a perspective view of a cap as in FIG. 1 with first and second levers in closed and unsealed configurations, respectively.
Figure 3B:
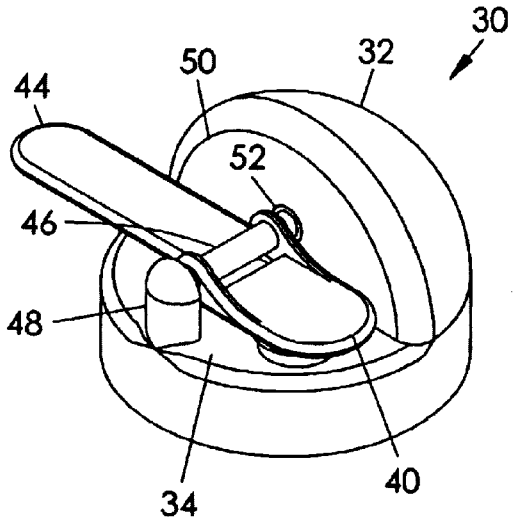
FIG. 3*b* is a perspective view of a cap as in FIG. 1 with first and second levers in closed and sealed configurations, respectively.
Figure 3C:
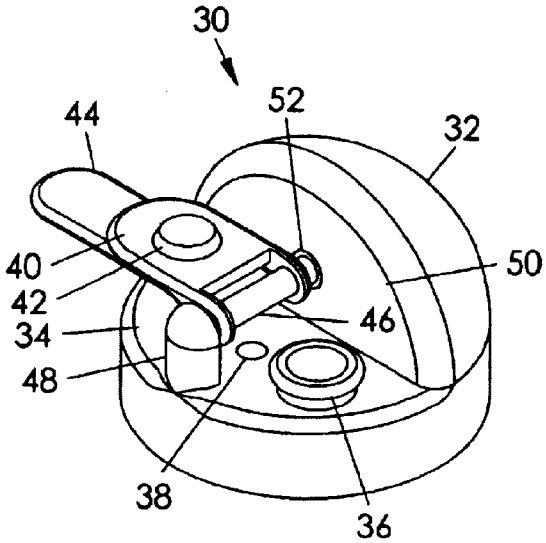
FIG. 3*c* is a perspective view of a cap as in FIG. 1 with first and second levers in open and sealed configurations, respectively.

Therefore, the cap 30 includes first 40 and second 44 levers pivotally coupled to the cap 30 (FIGS. 3*a* through 3*c*). More particularly, the second lever 44 is fixedly or integrally attached to a pin 46 that is pivotally coupled at opposed ends to a post 48 and a side wall 50 of the dome-shaped structure 32. In fact, the pin 46 extends completely through the side wall 50 as to be further described later and the hole through the side wall 50 is sealed with an O-ring 52 or the like. The first lever 40 is pivotally coupled to the pin 46 and is rotatable thereabout. It is understood that the pin 46 operates as a pivot axis for both levers. The second lever 44 includes a length that is greater than a length of the first lever 40 and may completely cover the first lever 40 at certain configurations as to be described below.

The first lever 40 is pivotally movable about the pivot axis established by the pin 46 between a closed configuration covering the inlet port 36 and an open configuration displaced 180° from the inlet port 36. A cork 42 or rubber stopper is fixedly attached to a bottom side of the first lever 40 and includes a configuration complementary to that of the inlet port 36 for sealing the inlet port at the closed configuration (FIGS. 3*a* and 3*b*). Therefore, moving the first lever 40 from a closed configuration to an open configuration releases the partial vacuum within the container 22 and allows water to flow out the outlet aperture in a water/air exchange if the outlet aperture is not sealed.

Figure 2A:
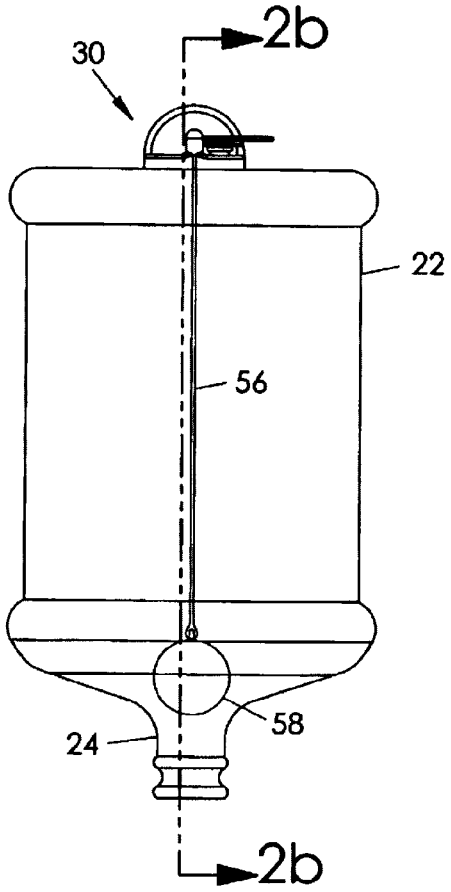
FIG. 2*a* is a side view of a water container as in FIG. 1 removed from the water cooler/dispenser unit.
Figure 2B:
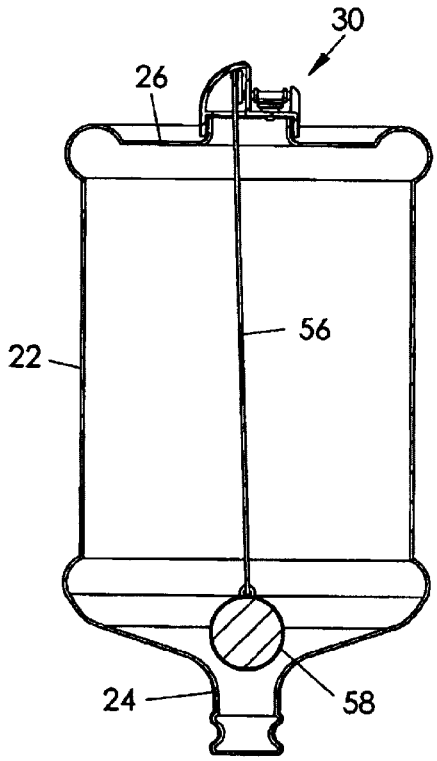
FIG. 2*b* is a sectional view of the water container taken along line 2*b*—2*b* of FIG. 2*a;*
Figure 4B:
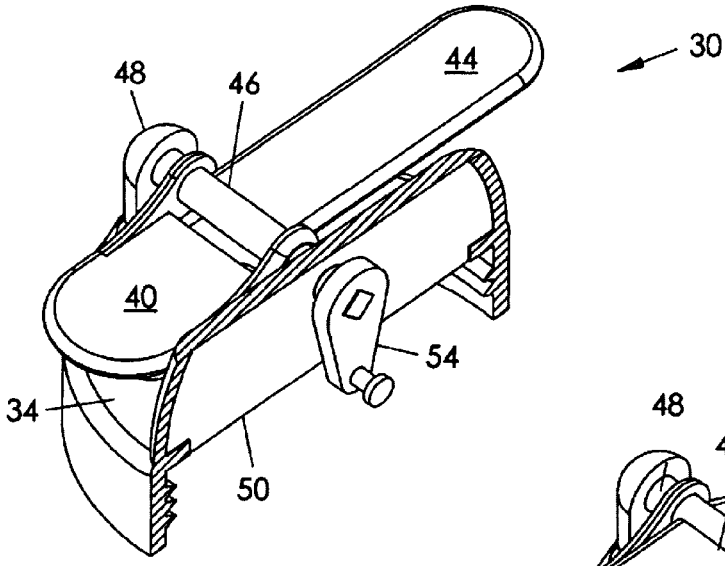
FIG. 4*b* is a sectional view taken along line 4*b*—4*b* of FIG. 4*a;*
Figure 4C:
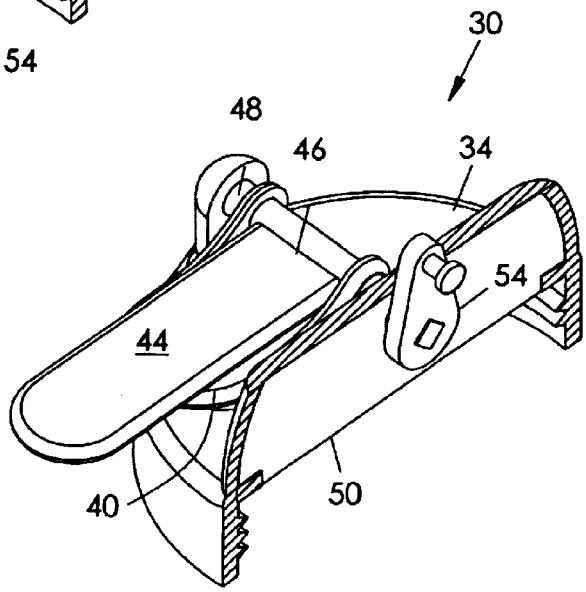
FIG. 4*c* is a sectional view as in FIG. 4*b* with first and second levers in closed and unsealed configurations, respectively.
Figure 4A:
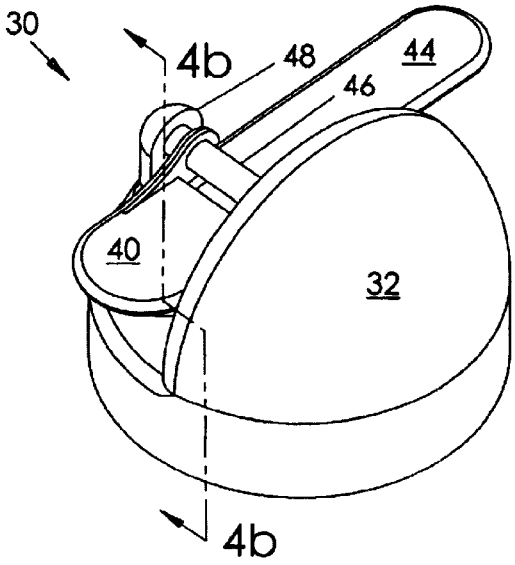
FIG. 4*a* is a perspective view of the cap as in FIG. 3*b* taken from another angle.

Therefore, the second lever 44 operates an assembly for selectively sealing and unsealing the outlet aperture. More particularly, the end of the pin 46 that extends through the side wall 50 of the dome structure 32 is fixedly attached to a flange 54 (FIG. 4*b*). The flange 54, in turn is connected to a ball valve 58 with a cord 56, thereby suspending the ball valve 58 in the container (FIGS. 1 and 2*b*). The ball valve 58 is constructed of a material having a density greater than the density of water such that it does not float. It is understood that the flange 54 is situated within the interior of the dome structure that is in communication with the interior of the container 22. A pivotal movement of the second lever 44 operates the pin 46 and the flange 54 such that the ball valve 58 is either raised or lowered relative to the neck 24 of the container 22. In other words, the second lever 44 may be rotated about the pivot axis established by the pin 46 between a first configuration in which the ball valve 58 seals the outlet aperture (FIGS. 3*b* and 3*c*) and a second configuration in which the ball valve 58 is spaced above the outlet aperture (FIGS. 2*b* and 3*a*).

A fundamental problem with a refillable water bottle system is that a user may inadvertently open the inlet port 36 and thereby release the internal vacuum prior to sealing the outlet aperture. This immediately changes a "closed system" into an "open system" and permits all of the water remaining in the container to flow out of the outlet aperture as it is replaced by air drawn in through the inlet port 36. The reservoir water level is ineffective to stop this water/air exchange in that air is entering from a location other than through the reservoir. However, this problem is minimized or even eliminated by the configuration of the first 40 and second 44 levers of the present invention.

In operation, the first 40 and second 44 levers operate pivotally about a single horizontal pivot axis established by the pin 46. Further, the second lever 44 is larger than the first lever 40. Still further, the levers are independently operable. Therefore, when the first lever 40 is at its closed configuration and the second lever 44 is at its unsealed configuration, the first lever 40 is completely covered by the second lever 44 so as to make the first lever 40 inaccessible (FIG. 3*a*). In this configuration, the outlet aperture is unsealed and the inlet port 36 is closed, thus allowing normal dispensing of water from the container 22 using the conventional water dispenser unit 6. When the container 22 is partially or completely empty and needs to be refilled, the user may desire to move the first lever 40 to its open configuration so as to expose the inlet port 36 for refilling. However, the second lever 44 obstructs the first lever 40 (FIG. 3*a*) and must first be rotated to its sealed configuration (FIG. 3*b*) before the first lever 40 may be operated. Once the second lever 44 has caused the outlet aperture to be sealed by the ball valve 58, opening the inlet port 36 will not cause the container 22 to drain uncontrollably (FIG. 3*c*). Conversely, the second lever 44 cannot be moved to its unsealed configuration until the first lever 40 is first moved back to its closed configuration (FIG. 3*b*).

Figure 5:
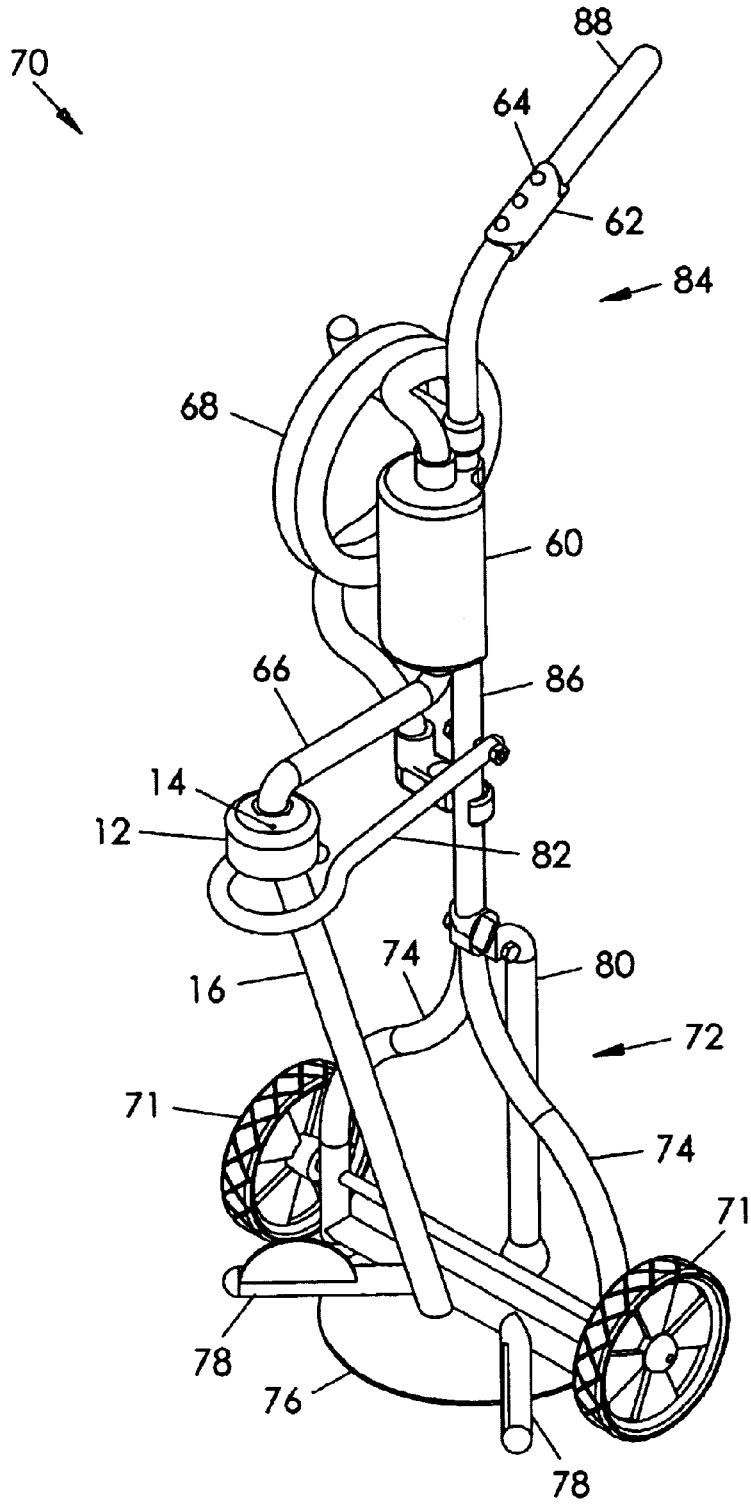
FIG. 5 is a perspective view on an enlarged scale of the cart as in FIG. 1 with a refill water bottle removed.

The refillable water bottle system 20 according to the present invention further includes a self-priming pump 60 that is capable of conveying water from a refill water bottle 10 through the inlet port 36 and into the container 22. This eliminates the need to lift and mount refill bottles. The system 20 further includes a cart 70 particularly designed for transporting a refill water bottle 10 (FIG. 5). The cart 70 includes a framework having a base portion 72 and a handle portion 84. The base portion 72 includes a pair of generally upstanding support braces 74 and a support plate 74 coupled thereto in a generally perpendicular configuration. Further, a pair of guide bars 78 are attached to the base portion 72 and extend radially outwardly along the support plate 74. The guide bars 78 help to stabilize a refill bottle's position on the support plate 74. A pair of wheels 71 are rotatably coupled to the base portion 72 with an axle or other suitable means. The handle portion 84 includes an upstanding member 86 and an upper member 88 extending at a generally 45° angle from the upstanding member 86 and is ergonomically beneficial to a user. The cart 70 further includes a support leg 80 pivotally coupled to the base portion 72 at a point where the support braces 74 converge for attachment to the handle portion 84 (FIG. 5). The support leg 80 may be pivotally moved between a collapsed configuration parallel to the upstanding member 86 of the handle portion 84 and an extended configuration in which the free end thereof is displaced from the base portion 72. In the extended configuration, the cart 70 may be supported by the support leg 80 in a rearwardly tipped orientation for use. In addition, a hook bracket 82 is coupled to the upstanding member 86 of the handle portion 84 for releasably retaining the neck of a refill water bottle 10.

The pump 60 may be coupled to the upstanding member 86 of the handle portion 84 although being coupled directly to the water dispenser unit 6 would also be suitable for certain applications. More particularly, handle attachment of the pump 60 would be useful for refill bottles that must be transported to multiple water dispenser units, e.g. an office environment, whereas attachment of the pump 60 to the water dispenser unit 6 would be useful for home use.

One end of a first tube 66 is connected to the pump 60 while an opposed end thereof is adapted to be connected to a refill water bottle 10. Preferably, refill water bottles for use with the present invention include a cap 30 having an air port 14 and includes a straw 16 depending therefrom into the bottle. Therefore, water may be suctioned out of the refill bottle upon an operation of the pump 60. Of course, the cap 30 and straw 16 may be a separate accessory. One end of a second tube 68 is connected to the pump 60 while an opposed end thereof may be connected to the inlet port 36 of the main container 22. Therefore, an operation of the pump 60 conveys water from a refill water bottle 10 into the main container 22. The cap 30 includes a one-way air valve 38 which allows air to be displaced from the container 22 by the refill water. It is understood that there is no risk of air escaping through the one-way air valve 38 during normal operation in that air is actually trying to enter the container in that context as water is being dispensed.

The pump 60 may include various control elements and a control panel 62 may be coupled to the upper member 88 of the handle portion 84 of the cart 70 for operation thereof. The control panel 62 may include a manual on/off button 64 of a type in which the user must hold the button down in order for the pump to operate. Of course, an automatic mode of operation would also be possible and would include certain safeguards to prevent overfilling. More particularly, the control panel 62 may include conventional timer circuitry such that the pump 60 would run for a certain amount of time corresponding to a predetermined volume of water. The container 22 may include volume indicia (not shown) to assist a user in setting the timer appropriately. For example, if the container needs two gallons of water to be added, the user may set the pump timer to run for a predetermined time in order to add just the right amount of water to the container 22. In addition, the system may include feedback sensors to aid in the refill process. More particularly, a water sensor may be employed for detecting that water still remains in the refill water bottle. An overflow sensor (float valve or pressure sensor) may be used in the container 22 to prevent overfilling. It is also understood that the pump 60 may be powered by current from a standard wall outlet or by a rechargeable battery.

Accordingly, the refillable water bottle system 20 enables a user to enjoy the benefits of bottled water without having to lift, invert, and mount heavy portable water bottles. This system also enables a user to conveniently refill the main water container 22 without inadvertently allowing water in the container 22 to flow out its outlet aperture.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A refillable water bottle system for use with a bottled water dispenser of a type adapted to receive an inverted bottle of water and dispense water therefrom, said refillable water bottle system comprising:

a container for holding water having opposed top and bottom walls and a continuous side wall extending between said top and bottom walls, said bottom wall defining an outlet aperture;

a cap coupled to said top wall and defining an inlet aperture through which water may be conveyed into said container;

a first lever pivotally coupled to said cap and pivotally movable between a closed configuration covering said inlet aperture and an open configuration displaced from said inlet aperture;

a second lever pivotally coupled to said cap and pivotally movable between unsealed and sealed configurations;

a ball valve connected to said second lever with a cord and suspended thereby in said container, said ball valve being spaced from said outlet aperture when said second lever is at said unsealed configuration and covering said outlet aperture when said second lever is at said sealed configuration.

2. The refillable water bottle system as in claim 1 wherein said second lever covers said first lever when said first and second levers are at said closed and unsealed configurations, respectively, whereby said first lever is inaccessible and may not be manipulated until said second lever is at said sealed configuration.

3. The refillable water bottle system as in claim 1 wherein:

said second lever includes a rod at one end thereof, said rod being rotatably coupled to said cap and defining a horizontal pivot axis;

said second lever includes a flange fixedly attached to said rod, said cord being connected to said flange for raising or lowering said ball valve suspended in said container upon a corresponding movement of said second lever; and said first lever is rotatably coupled to said rod for selective rotation about said horizontal pivot axis.

4. The refillable water bottle system as in claim 1 wherein:

said cap is releasably coupled to said container;

said first lever includes a plug fixedly attached to a bottom surface thereof and having a configuration complementary to a configuration of said inlet port for sealing said inlet port when said first lever is at said closed configuration.

5. The refillable water bottle system as in claim 1 further comprising:

a cart having a framework adapted to support a bottle of water, said cart having a pair of wheels rotatably coupled to said framework adjacent a lower end thereof;

a pump coupled to said framework;

a first tube having one end connected to said pump and another end adapted to be connected to said bottle of water; and a second tube having one end connected to said pump and another end adapted to be connected to said inlet port of said cap, whereby water may be conveyed from said bottle of water into said container upon an operation of said pump.

6. The refillable water bottle system as in claim 5 wherein said framework includes a base portion and a handle, said handle extending upwardly from said base portion at about a 45° angle.

7. The refillable water bottle system as in claim 5 wherein said base portion of said framework includes:

a pair of generally upstanding support braces and a support plate connected to said pair of support braces in a generally perpendicular relationship; and a pair of guide bars extending radially along said support plate for stabilizing said bottle of water when supported upon said support plate.

8. The refillable water bottle system as in claim 5 wherein said cart further includes means pivotally connected to said framework for releasably retaining a neck of said bottle of water.

9. The refillable water bottle system as in claim 5 wherein said cart includes a support leg pivotally coupled to said framework, said support leg being movable between a collapsed configuration and an extended configuration for supporting said cart in a rearwardly tipped configuration.

10. A refillable water dispensing system for use in combination with a bottled water dispenser of a type having a reservoir and defining an opening adapted to receive an inverted bottle of water for filling said reservoir for valved dispensing of the bottled water therefrom, said refillable water dispensing system comprising:

a container having opposed top and bottom walls with a continuous side wall extending therebetween, said top wall defining an aperture, said bottom wall forming a neck adapted to be received by the bottled water dispenser opening such that said container may be received thereby, said neck defining an outlet aperture;

a cap releasably coupled to said top wall of said container for covering said aperture, said cap defining an inlet port through which water may be conveyed into said container;

a first lever pivotally coupled to said cap and pivotally movable between a closed configuration covering said inlet aperture and an open configuration displaced from said inlet aperture;

a second lever pivotally coupled to said cap and pivotally movable between unsealed and sealed configurations;

a ball valve connected to said second lever with a cord and suspended thereby in said container, said ball valve being spaced from said outlet aperture when said second lever is at said unsealed configuration and covering said outlet aperture when said second lever is at said sealed configuration;

wherein water in said container is allowed to flow downstream through said outlet aperture and into the reservoir of the bottled water dispenser when said second lever is at said unsealed configuration unless a level of water received in said reservoir covers said outlet aperture and said first lever is at said closed configuration.

11. The refillable water dispensing system as in claim 10 wherein: said cap includes a chamber in communication with said top wall aperture when said cap is coupled to said top wall;

said second lever includes a rod at one end thereof, said rod being rotatably coupled to said cap and defining a horizontal pivot axis, said rod including one end extending into said chamber;

said second lever includes a flange fixedly attached to said one end of said rod, said cord being connected to said flange for raising or lowering said ball valve upon a corresponding movement of said second lever; and said first lever is rotatably coupled to said rod for selective rotation about said horizontal pivot axis.

12. The refillable water dispensing system as in claim 11 wherein said second lever includes a length greater than a length of said first lever such said second lever covers said first lever when said first and second levers are at said closed and unsealed configurations, respectively, whereby said first lever may not be not be moved from said closed configuration so long as said second lever is at said unsealed configuration.

13. The refillable water dispensing system as in claim 10 wherein said container includes a cube-shaped configuration.

14. The refillable water dispensing system as in claim 10 wherein:

said ball valve includes a density greater than a density of the water in said container; and said first lever includes a plug fixedly attached to a bottom surface thereof and having a configuration complementary to a configuration of said inlet port for sealing said inlet port when said first lever is at said closed configuration.

15. The refillable water dispensing system as in claim 10 further comprising:

a pump;

a first tube having one end connected to said pump and another end adapted to be connected to a bottle of water, whereby to draw water therefrom;

a second tube having one end connected to said pump and another end adapted to be connected to said inlet port of said cap, whereby to convey the water drawn from said bottle of water into said container.

16. The refillable water dispensing system as in claim 15 further comprising:

a cart having a base portion adapted to support a bottle of water and a handle extending upwardly from said base portion, said cart having a pair of wheels rotatably coupled to said base portion;

wherein said base portion includes a pair of generally upstanding support braces and a support plate connected to said pair of support braces in a generally perpendicular configuration; and wherein said base portion includes a pair of guide bars extending radially along said support plate for stabilizing said bottle of water when supported upon said support plate.

17. The refillable water dispensing system as in claim 15 wherein said cart includes a support leg pivotally coupled to said base portion, said support leg being movable between a collapsed configuration for storage and an extended configuration for supporting said cart in a rearwardly tipped configuration.

18. The refillable water dispensing system as in claim 15 wherein said pump is coupled to said handle of said cart.

19. The refillable water dispensing system as in claim 15 further comprising means electrically connected to said pump for automatically ceasing operation thereof when said container is substantially refilled.

20. A refillable water bottle system for use with a bottled water dispenser of a type having a reservoir and defining an opening adapted to receive an inverted bottle of water for filling said reservoir for valved dispensing of the bottled water therefrom, said refillable water dispensing system comprising:

a container having opposed top and bottom walls with a continuous side wall extending therebetween, said top wall defining an aperture, said bottom wall forming a neck adapted to be received by the bottled water dispenser opening such that said container may be received thereby, said neck defining an outlet aperture;

a cap releasably coupled to said top wall of said container for covering said aperture, said cap defining an inlet port through which water may be conveyed into said container;

a first lever pivotally coupled to said cap and pivotally movable about a horizontal axis between a closed configuration covering said inlet aperture and an open configuration displaced from said inlet aperture;

a second lever coupled to said cap and pivotally movable about said horizontal axis between unsealed and sealed configurations;

a ball valve connected to said second lever with a cord and suspended thereby in said container, said ball valve being spaced from said outlet aperture when said second lever is at said unsealed configuration and covering said outlet aperture when said second lever is at said sealed configuration;

wherein water in said container is allowed to flow downstream through said outlet aperture and into the reservoir of the bottled water dispenser when said second lever is at said unsealed configuration unless a level of water received in said reservoir covers said outlet aperture and said first lever is at said closed configuration;

wherein said second lever covers said first lever when said first and second levers are at said closed and unsealed configurations, respectively, whereby said first lever is inaccessible and may not be pivotally moved from said closed configuration while said second lever is at said unsealed configuration.

* * * * *